US005611889A

United States Patent [19]

Leary et al.

[11] Patent Number: 5,611,889

[45] Date of Patent: Mar. 18, 1997

[54] EXOTHERMIC BLEACHING OF HIGH-YIELD PULPS SIMULTANEOUSLY WITH OXYGEN AND BOROHYDRIDE

[75] Inventors: Gordon Leary, Baie d'Urfe; David Giampaolo, Pointe Claire, both of Canada

[73] Assignee: Pulp and Paper Research Institute of Canada, Pointe Claire, Canada

[21] Appl. No.: 551,046

[22] Filed: Oct. 31, 1995

Related U.S. Application Data

[63] Continuation of Ser. No. 297,288, Aug. 29, 1994, abandoned.

[51] Int. Cl.[6] ..... D21C 9/147; D21C 9/16

[52] U.S. Cl. ..... 162/65; 162/78; 162/80

[58] Field of Search ..... 162/80, 65, 78

[56] References Cited

U.S. PATENT DOCUMENTS

| | | | |
|---|---|---|---|
| 1,163,438 | 12/1915 | Muller . | |
| 3,100,732 | 8/1963 | Smedberg | 162/78 |
| 3,284,283 | 11/1966 | Kindron et al. | 162/25 |
| 3,384,533 | 5/1968 | Meylan et al. | 162/65 |
| 3,981,765 | 9/1976 | Kruger et al. | 162/80 |
| 4,248,662 | 2/1981 | Wallick | 162/19 |
| 4,756,798 | 7/1988 | Lachenal et al. | 162/24 |

OTHER PUBLICATIONS

D.H. Andrews et al. "The Bleaching of Pulp." Ed. Tappi Press (1979) p. 215.

T.S. Khristov & T. Semov, "Oxygen–alkali Treatment of High Temperature Thermo–mechanical Pulp" Tseluloza Khartiya 13 (5) 18–21 (1982).

Michel A.J. et al. "Bleaching and Yellowing of Eucalypt Chemimechanical Pulps. Diffuse Reflectance Spectra of Oxygen Bleached Pulps." Appita 44 333–336 (1991).

V. Loras & N. Soteland, "High Brightness Bleaching of Mechanical Pulp". Norsk Skogindustri 26 (10) 255–258 (1972).

J. Polcin & W.H. Rapson "Effects of Bleaching Agents on the Absorption Spectra Lignin in Groundwood Pulps. Part 1. Reductive Bleaching" Pulp and Paper Magazine of Canada 72 (3) T103–T125, (1971).

J.Gierer and N.–O. Nilvebrant "Studies on the Degradation of Residual Lignin Structures by Oxygen". Part I. Mechanism of Autoxidation of 4,4–Dihydroxy–3,3'–Dimethoxystilbene in Alkaline Media. Holzforshung 40 (suppl) 107–113 (1986).

S. Ljunggren & Eva Johansson, "The kinetics of lignin reactions during oxygen bleaching. Part 2. The reactivity of 4,4'–dihydroxy–3,3'–dimethoxy–stilbene and B–aryl ether structures" Nordic Pulp and Paper Research Journal (3) 148–154 (1990).

(List continued on next page.)

*Primary Examiner*—Steve Alvo

*Attorney, Agent, or Firm*—Swabey Ogilvy Renault

[57] ABSTRACT

A process for bleaching high-yield (mechanical or chemimechanical) pulps to high brightnesses and low yellownesses (b*) in a single treatment employs di-oxygen gas ($O_2$), alkaline agent and a borohydride. The combined treatment gives brightnesses comparable with those achieved with stabilized alkaline hydrogen peroxide. By comparison the reaction of di-oxygen and alkali alone darkens high-yield pulps; and treatment with alkaline borohydride in the absence of added di-oxygen bleaches to give only about half the brightness gained if di-oxygen is added. The bleaching may possibly occur through the conversion of di-oxygen molecules ($O_2$) to hydroperoxide ions (HOO–) utilizing ionized phenolic groups or hydroquinones in the lignin. The hydroperoxide ions are thus generated in situ in the lignin and can destroy colored lignin chromophores. Without the addition of borohydride the lignin phenolic groups would be irreversibly oxidized. The primary role of the borohydride is to regenerate the phenolic groups and maintain a di-oxygen hydroperoxide ($O_2$)(HOO–) cycle. In a secondary role, the borohydride also contributes to the bleaching by reducing radicals, organic peroxides and carbonyl compounds in the pulps.

25 Claims, 1 Drawing Sheet

OTHER PUBLICATIONS

D.T. Sawyer & Edward J. Nanni Jr. "Redox Chemistry of $O_2$ Chemistry and Peroxides" Eds. M.A.J. Rodgers and E. Powers. Academic Press (1981) 15–44.

M.R. san Clemente, K.V. Sarkanen and S.E. Sundin "Alkaline autoxidation of 4–ethylguaiacol" Svensk Papperstidning R1–R5 (1980).

J. Gierer "Chemistry of delignification. Part 2: Reactions of lignins during bleaching" Wood Sci. Technol. 20 1–33 (1986).

J.F. Corbett "The Chemistry of Hydroxyquinones. Part II. The Autoxidation of 3,6–Dimethylbenzene–1,2,4–triol" J. Chem. Soc.(C) 611–620 (1967).

EXOTHERMIC BLEACHING OF HIGH-YIELD PULPS SIMULTANEOUSLY WITH OXYGEN AND BOROHYDRIDE

This is a continuation of application, Ser. No. 08/297,288, filed Aug. 29, 1994, now abandoned.

BACKGROUND TO THE INVENTION

1. Field of Invention

The invention relates to the bleaching of high-yield lignin-containing pulps to be used for papermaking. It is concerned with the use of di-oxygen ($O_2$), an alkaline agent, and borohydride (also known as tetrahydroborate, $BH_4$–) to produce high brightness and low yellowness pulps.

2. Description of the Prior Art

Di-oxygen in the presence of an alkaline agent, for example, alkali ($O_2$/OH–) is used commercially to bleach wood pulp or cotton pulp but not high-yield pulps. $O_2$/OH– bleaches chemical pulps by degrading and dissolving the residual lignin (see for example U.S. Pat. No. 1,163,438 which describes the bleaching of cotton by alkali and oxygen and U.S. Pat. No. 4,248,662 which uses oxygen, alkali and borate salts to bleach wood pulps by delignifying them).

In high-yield pulps that retain the lignin, bleaching by lignin removal is impractical and lignin-containing pulps darken rather than bleach under the influence of di-oxygen and alkali, D. H. Andrews et al, "The Bleaching of Pulp", Ed. Tappi Press (1979) p. 215; and T. S. Khristov and T. Semov "Oxygen-alkali treatment of High-temperature Thermomechanical Pulp", Tseluloza Khartiya 13 (5) 18–21 (1982).

By contrast, the bleaching of high-yield pulps with added alkaline hydrogen peroxide [$H_2O_2$/OH–] is effective and is widely used by the pulp and paper industry. The efficacy of mechanical pulp bleaching using added alkaline peroxide is marginally improved if di-oxygen is present. U.S. Pat. No. 4,756,798 describes that there is an increase of 1–2 brightness points, but also that it is not known why this occurs.

Inserting a di-oxygen/alkali ("O") stage before an alkaline peroxide ("P") bleaching stage gives a lower brightness than alkaline peroxide alone, Michell et al, Bleaching and Yellowing of Eucalypt Chemimechanical Pulps. Diffuse Reflectance Spectra of Oxygen Bleached Pulps, Appita 44 333–336 (1991).

Single stage bleaching with 4% added alkaline peroxide increases the brightness of mechanical pulps made from Canadian spruce fibres by about 20 points and ISO brightnesses up to about 80% can be obtained by repetitive treatments. The main disadvantages of adding hydrogen peroxide are that it is unstable (both during bleaching and in storage) and must be used in conjunction with a number of additives, for example, magnesium sulphate; sodium silicate; and chelating or sequestering agents such as DTPA or EDTA. The need for these additives significantly increases the cost of using the peroxide. Also the addition of silicates may lead to unwanted deposits when mill water is recycled and the discharge of DTPA or EDTA in effluents is environmentally undesirable.

Di-oxygen is stable and of lower cost than peroxide. It is readily available and is generally beneficial to the natural environment. A di-oxygen-based bleaching system could avoid the use of some or all DTPA, EDTA, magnesium sulphate or silicates. It would be a step forward if oxygen could be used in place of peroxide.

There are a number of reports and patents on the use of sodium borohydride ($NaBH_4$), alone or in sequence with a second stage using added hydrogen peroxide, to bleach high yield pulps:

(i) Lords and Soteland, "High Brightness Bleaching of Mechanical Pulp", Norsk Skogindustri 26 (10) 255–258 (1972), achieved an optimum brightness increase of 12.5 pts. when spruce groundwood was treated with 1.2% $NaBH_4$ alone. They also reported that two stage bleaching with added peroxide in the second stage gave a maximum total increase of 20 pts.

(ii) Smedberg, U.S. Pat. No. 3,100,732 describes the combined use of borohydride and added alkaline peroxide, reporting higher groundwood brightnesses of 1.2 (0.1% $NaBH_4$) and 4 (1% $NaBH_4$) relative to the brightness obtained when added alkaline peroxide was used alone.

(iii) Kruger et al., U.S. Pat. No. 3,981,765, used borohydride to impregnate wood chips prior to heating and mechanically defiberizing.

(iv) Polcin and Rapson, "Effects of Bleaching Agents on the Absorption Spectra of Lignin in Groundwood pulps; Part 1. Reductive Bleaching" Pulp and Paper Magazine of Canada 72 (3) T103–T125, (1971), obtained a brightness increase of 5.8 points when eastern spruce groundwood was treated with 0.45% $NaBH_4$.

There is a report of the use of di-oxygen as part of a bleaching sequence, in a separate stage from borohydride. Michell et al referred to hereinbefore bleached eucalypt chemimechanical pulps in three stages with a $NaBH_4$-di-oxygen-peroxide ("B—O—P") sequence. Addition of a "B" stage prior to a "P" stage improved brightness by 3.5 pts. but addition of a di-oxygen "O" stage between the "B" stage and the "P " stage led to a 2 pts. brightness loss.

Sodium borohydride is frequently used to generate hydrosulphite for mechanical pulp bleaching by reaction with sulphur dioxide or sodium sulphite. U.S. Pat, No. 3,284,283 describes the in situ use of borohydride and sodium bisulphite to generate hydrosulphite on the pulp. This is a completely different use of borohydride from that described herein, which involves reaction in the presence of oxygen and the absence of sulphur compounds.

SUMMARY OF THE INVENTION

It is an object of this invention to provide a process for increasing the brightness and reducing the yellowness of a high-yield pulp.

It is a further object of this invention to provide an improved bleaching process for high-yield pulp.

In one aspect of the invention there is provided a process for increasing brightness and reducing yellowness of a high-yield pulp comprising bleaching the high-yield pulp with di-oxygen and a borohydride in the presence of an alkaline agent.

In another aspect of the invention there is provided a process for increasing brightness and reducing yellowness of a high-yield pulp comprising:

a) in a first stage, bleaching the high-yield pulp with di-oxygen and a borohydride in the presence of an alkaline agent, and subsequently, b) in a second stage, bleaching the pulp from a) with a peroxide in the presence of an alkaline agent.

The high-yield pulps may be thermo-mechanical pulps, ground wood pulps or chemi-mechanical pulps.

The invention relates to the use of di-oxygen and borohydride in the presence of alkaline agent as a single treatment to bleach mechanical pulps.

In one aspect the invention involves the use of di-oxygen and a borohydride simultaneously to achieve brightness gains of typically 15–20 pts. for softwoods and 10–15 pts. for hardwoods.

In another aspect the invention involves a two stage treatment in which the first stage involves the use of di-oxygen and a borohydride in an alkaline environment and the second stage involves treatment with alkaline hydrogen peroxide; in this aspect of the invention overall brightnesses of well over 80% are obtained.

DETAILED DESCRIPTION OF THE INVENTION WITH REFERENCE TO THE DRAWING

Figure 1:
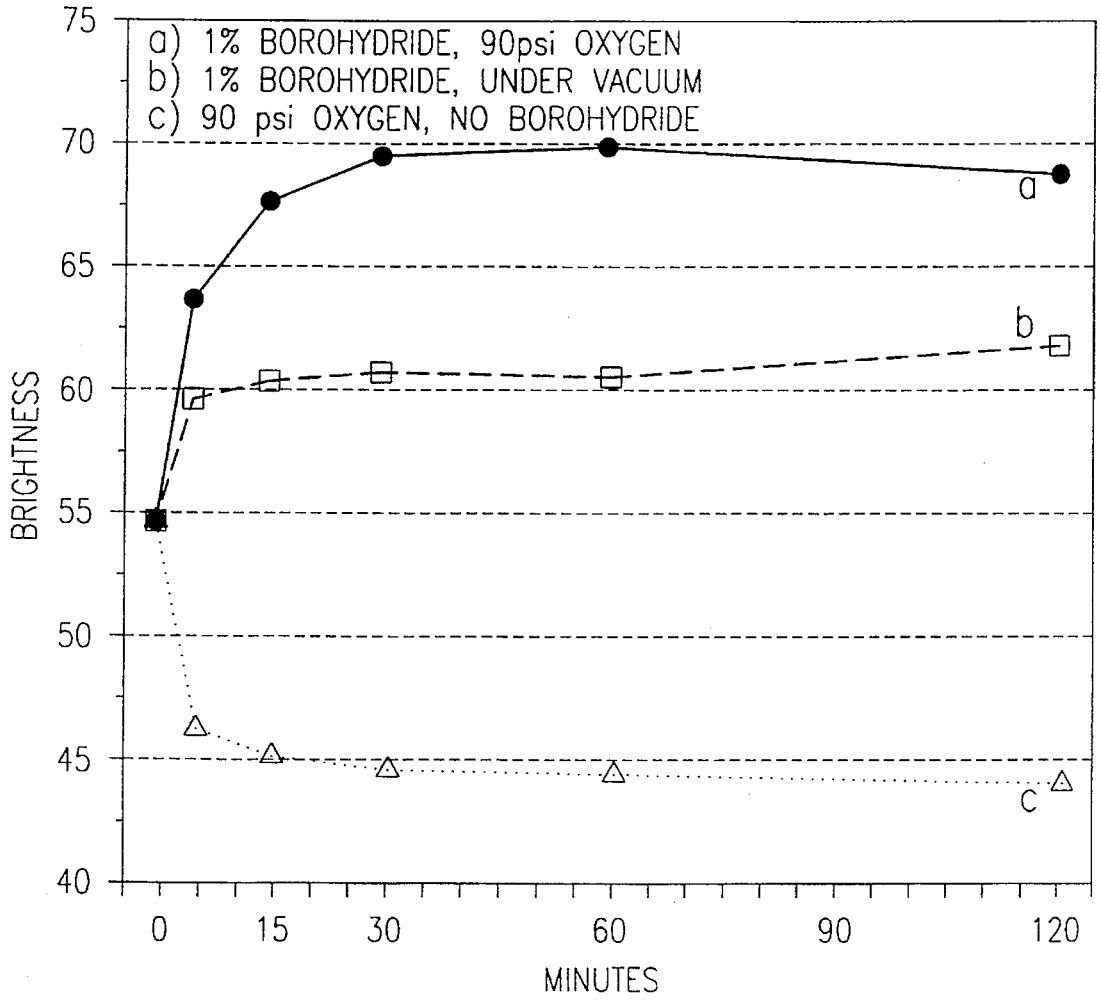
FIG. 1 illustrates graphically brightness results achieved in accordance with the invention and in comparable processes but omitting either di-oxygen or borohydride.

With further reference to FIG. 1, this shows plots of the change in brightness with time for TMP with 8%, by weight, NaOH at 60° C. under three process conditions in which the % is, by weight, based on the weight of the TMP, a) a process of the invention employing 1%, by weight, sodium borohydride and di-oxygen at 90 psi, b) a comparison process employing 1%, by weight, sodium borohydride, under vacuum, and thus omitting di-oxygen; and c) a comparison process employing di-oxygen at 90 psi, but omitting sodium borohydride, i) Reagents a) Di-Oxygen The di-oxygen referred to herein is, in particular, oxygen gas in which two oxygen atoms are covalently bound to form a molecule of oxygen $O_2$. The di-oxygen may comprise substantially pure oxygen or it may be in admixture with other gases which do not interfere with the bleaching operation, and are not otherwise detrimental to the pulp. For example, the source of the di-oxygen may be air.

b) Alkaline agent

The alkaline agent is, in particular, a substance which will generate hydroxide ions under the aqueous bleaching conditions. Preferred alkaline agents are the alkali metal hydroxides particularly potassium hydroxide and sodium hydroxide, and especially sodium hydroxide, however, alkaline earth metal hydroxides and alkali metal or alkaline earth metal carbonates, borates or other salts which may release hydroxide ions may be employed.

The alkaline agent is typically employed in an amount of 0.5 to 10%, preferably 1 to 8%, by weight, based on the weight of pulp.

The alkaline agent typically generates an alkaline pH of 9 to 14 for the bleaching.

c) Borohydride

The borohydride is, in particular, a metal borohydride, for example, an alkali metal or alkaline earth metal borohydride or zinc borohydride; sodium borohydride is especially preferred. Organic substituted borohydrides may also be used although they are more expensive.

The borohydride is suitably employed in an amount of 0.2 to 8%, preferably 1 to 5%, by weight, based on the weight of pulp.

(ii) Simultaneous or Synergistic Bleaching with Di-oxygen, Alkaline Agent, and Borohydride In this process the washed pulp is first treated with an alkaline solution of a borohydride, for example, up to 5% $NaBH_4$ and from 1–8% NaOH; based on pulp. An abundant supply of di-oxygen (or air) at atmospheric or higher pressures is brought into contact with the pulp and an exothermic reaction takes place. Depending on the $NaBH_4$ concentration, the pulp temperature will rise by up to 70° C. The pulp may be heated prior to the bleaching but this is not essential, and the bleaching reaction proceeds satisfactorily at ambient temperatures (20° C.). Temperatures in excess of 90° should be avoided because they appear to be detrimental to brightness. Bleaching occurs fairly rapidly, depending on the temperature and reagent concentrations. Typically, the temperature is 15° C. to 90° C., preferably 50° to 70° C. When it is complete the pH of the pulp is lowered to neutral or weakly acidic by treatment with a souring agent such as a mineral acid, sulphur dioxide or sodium metabisulphite. Depending on the initial brightness, brightness increases of from 10–22 pts are obtained. Better bleaching is obtained at medium to high (10–30%) consistencies and if the $NaBH_4$ is applied in more than one stage.

Treatment with borohydride and alkali ($NaBH_4$/OH–) alone will give brightness increases of about 5–10 pts., about half those obtained by the additional and simultaneous use of di-oxygen. This is evident from a comparison of plots a and b in FIG. 1. Treatment with di-oxygen and alkali ($O_2$/OH–) without the borohydride either has no bleaching effect or, depending on the temperature of the pulp, causes darkening or brightness loss of at least 10 pts. This is demonstrated by consideration of plot c in FIG. 1. A 2-stage sequential $NaBH_4$/OH– and $O_2$/OH– treatment (or vice-versa) shows no advantage over bleaching with $NaBH_4$/OH– alone.

Table I below shows some typical results with spruce TMP (consistency 20%) employing the bleaching process of the invention:

TABLE I

| $O_2$ (psi) | $NaBH_4$ % on pulp | NaOH % on pulp | Time hours | Start temp. °C. | Change in ISO % | Change in b* |
|---|---|---|---|---|---|---|
| 90 | 5 | 8 | 0.5 | 22 | +17.1 | −4.8 |
| 90 | 5 | 8 | 1 | 22 | +17.5 | −4.6 |
| 90 | 5 | 8 | 2 | 22 | +19.3 | −5.6 |
| 90 | 2.5 | 8 | 1 | 60 | +19.5 | −5.5 |
| 90 | 1 | 4 | 1 | 60 | +12.3 | −2.3 |
| 90* | 1* | 8* | 1* | 60* | | |
| 90* | 1* | —* | 1* | 60* | +21.6 | −5.8 |
| 15 | 5 | 8 | 3 | 22 | +19.6 | −6.0 |
| 150 | 5 | 8 | 1 | 22 | +17.9 | −4.7 |
| 90 | 0 | 8 | 1 | 60 | −10.0 | +10.1 |
| 90* | 0.5* | 4* | 1* | 60* | | |
| 90* | 0.5* | 4* | 1* | 60* | +11 | −1.9 |

*Two stages ii) Two-stage Process

In this embodiment, the above described bleaching with di-oxygen and borohydride in the presence of an alkaline agent is employed as the first stage of a two-stage process. The second stage of the two-stage process employs bleaching with a peroxide in the presence of an alkaline agent.

The alkaline agent may be of the same class as described for the first stage, to provide an alkaline pH of 9 to 14.

The peroxide is in particular hydrogen peroxide or a peroxyacid such as peracetic acid or an alkali metal peroxide, for example, sodium peroxide. Hydrogen peroxide is the preferred peroxide. Table II below shows comparable results with spruce TMP for bleaching with added alkaline peroxide, for $NaBH_4$ without di-oxygen, for a 2 stage treatment with alkali/di-oxygen/$NaBH_4$ followed by alkaline hydrogen peroxide, and for treatment with alkali and di-oxygen:

TABLE II

| Bleaching Reagent (% on pulp) | NaOH | Time hrs. | Temp °C. | _ISO % | _b* |
|---|---|---|---|---|---|
| Added Hydrogen Peroxide (4%) | to pH 11.5 | 4 | 60 | +17.9 | −1.8 |
| $NaBH_4$ (5%) No added oxygen | pH 11.7 | 3 | 60 | +10.8 | −4.8 |
| Stage 1: $O_2$ (90 psi) & $NaBH_4$ (5%); wash | 8% | 1 | 60 | +16.5 | −5.0 |
| Stage 2: added Hydrogen Peroxide (4%) | pH 10.8 | 2 | 60 | +10.4 total = +26.9 | −3.9 total = −8.9 |
| Di-oxygen only (90 psi) | 8% | 1 | 60 | −10.0 | +10.1 |

A high brightness and a low b* for softwood mechanical pulps were obtained in the two stage bleaching with di-oxygen and 5% borohydride in the first stage and 4% added alkaline hydroperoxide in the second phase. The prior bleaching with di-oxygen and borohydride led to a notably low hydrogen peroxide consumption in the second phase. After a bleaching time of 2 hours 82% of the added hydrogen peroxide was left as residual.

Table III below shows typical results with aspen TMP (each stage for 2 hours at 60° C. at 20% pulp consistency):

TABLE III

| Additional Reagents | $NaBH_4$ % on pulp | NaOH % on Pulp | _ISO % | _b* |
|---|---|---|---|---|
| none | 5 | 8 | +9.4 | −4.4 |
| 90 psi $O_2$ | 5 | 8 | +14.5 | −5.2 |
| 90 psi $O_2$ | 1 | 8 | +13.9 | −5.8 |
| (3 stages) | 1 | | +1.1 | −1.3 |
| | 1 | | +0.8 total = +15.8 | −0.4 total = −7.5 |
| 4% added hydrogen peroxide | 0 | 6.5 | +19.0 | −7.9 |
| Stage 1: 90 psi $O_2$; | 5 | 8 | | |
| Stage 2: added 4% hydrogen peroxide | then 0 | then 6.5 | +19.7 | −8.3 |

The Mechanism

While not bound by any theory, it appears that at least two reactions contribute to the bleaching by di-oxygen, alkali and borohydride:

Reaction 1

A novel sequence of reactions resulting in the sustained production of hydroperoxide (HOO−) ions capable of in situ bleaching. The sequence is initiated by a reaction between the lignin, hydroxide, and di-oxygen and is sustained through the action of the borohydride. There may be several separate reaction paths but one is envisaged to be as follows:

(i) Ionisation of the lignin phenols by the alkaline agent to give phenoxide ions.

(ii) Formation of hydroperoxide (HOO−) ions by reaction of the phenoxide ions with di-oxygen.

The most likely routes for the formation of (HOO−) ions are:

(a) via formation of phenoxy radicals and superoxide ($O_2$−.) J. Gierer et al, Studies on the Degradation of Residual Lignin Structures by Oxygen. Part.1 Mechanism of autoxidation of 4,4'-dihydroxy-3,3'-dimethoxystilbene in alkaline media, Holzforshung 40 (suppl) 107–113 (1986); and S. Ljungren et al, The kinetics of lignin reactions during oxygen bleaching. Part 2. The reactivity of 4,4'-dihydroxy-3,3'-dimethoxystilbene and beta-aryl ether structures, Nordic Pulp and Paper Research Journal (3) 148–154 (1990); followed by dismutation of the superoxide to di-oxygen and hydroperoxide (HOO−), D. T. Sawyer et al, Redox Chemistry of $O_2$ and Peroxides, Eds. M. A. J. Rodgers and E. Powers, Academic Press (1981) 15–44, or (b) via formation of organic hydroperoxides, the aforementioned J. Gierer et al, and M. R. san Clemente et al, Alkaline autoxidation of 4-ethylguaiacol, Svensk Papperstidning R1–R5 (1980) and followed by reductive cleavage by the borohydride, forming (HOO−) ions.

(c) via formation and autoxidation of hydroquinones, J. F. Corbett, The Chemistry of Hydroxyquinones Part II. The Autoxidation of 3,6-Dimethylbenzene-1,2,4-triol, J. Chem. Soc.(c) 611–620 (1967).

(iii) The production of (HOO−) is sustained because the borohydride regenerates phenoxides or hydroquinones for further reaction with fresh di-oxygen.

Hydroperoxide (HOO−) ions are known to be the active intermediates in alkaline hydroperoxide bleaching J. Gierer, Chemistry of Delignification. Part II. Reactions of Lignins During Bleaching, Wood Sci. Technol. 20 1–33 (1986). They bleach by removing carbonyl and unsaturated chromophores through nucleophilic attack and substitution. In the combined $NaBH_4/O_2$ process of the invention, HOO− ions are presumably formed in situ where they can bleach efficiently and without the same need for stabilisation by DTPA or similar additives. In an experiment with aspen the addition of DTPA, sodium silicate and magnesium sulphate prior to $NaBH_4/O_2$ bleaching actually gave a 1.2 pt. lower brightness than $NaBH_4/O_2$ bleaching without adding these traditional peroxide stabilisers.

Reaction 2

The borohydride also bleaches in its own right by direct reduction of chromophores formed, for example, by reaction with di-oxygen or naturally present in the pulp. The borohydride particularly reduces quinone, aromatic carbonyl, and conjugated carbonyl chromphores to colourless hydroquinone and alcoholic structures. The use of a borohydride/di-oxygen sequence is new. Bleaching through the direct borohydride reduction of chromophores occurs independently of the reaction with di-oxygen, though, by modifying the lignin, borohydride may help control the di-oxygen reactions. Borohydride will also reduce carbonyl compounds that may be formed by the action of alkali and di-oxygen.

EXAMPLES

The following examples use washed commercial samples of TMP from spruce or CTMP from aspen. Depending on the history of the pulps, the spruce TMP had unbleached ISO brightnesses between 49.9 and 56.3%, and b* values of 14.7 to 16.4. The aspen CTMP had an unbleached ISO brightness of 64.6% and a b* of 13.0, measured according to the ISO standard.

EXAMPLE 1

Bleaching of Spruce TMP (unbleached brightness 49.65%, b* 16.54) by a single treatment with di-oxygen (atmospheric pressure), 5% $NaBH_4$ and 8% NaOH.

The calculated amount of an aqueous solution of sodium borohydride and sodium hydroxide to give a consistency of 30% was added to the dry pulp. The pulp was thoroughly mixed in a Hobart mixer, placed in a glass column, and di-oxygen gas passed through it at a flow rate of 1 L/minute. After 3 hours the pulp was dispersed in water to 1% consistency and sodium meta bi-sulphite added to bring the pH of the suspension to between 6 and 7. Handsheets were made from the washed pulp in the conventional manner. The ISO brightness was 69.27%, an increase of 19.62 pts, the yellowness (b*) was 10.56.

EXAMPLE 2

Bleaching of Spruce TMP (unbleached brightness 49.65%, b* 16.54) by a two stage treatment with, di-oxygen (90 psi), 1% $NaBH_4$ and 8% NaOH The calculated amount of an aqueous solution of sodium borohydride and sodium hydroxide to give a consistency of 20% was added to the dry pulp. The pulp was thoroughly mixed in a Hobart mixer and placed in a stainless steel bomb fitted with a gas inlet. The bomb was sealed and placed in a water bath at 60° C. The air was removed from the bomb by evacuation and replaced with an atmosphere of di-oxygen at 90 psi. The temperature of the pulp, which rose to a maximum of 64.2° C., was monitored with a thermocouple probe. After 1 hour the pressure was released and the bomb opened. The liquor was removed from the pulp by squeezing and replaced with a fresh solution of borohydride (1% on pulp) and sodium hydroxide (8% on pulp), adjusted to give a consistency of 20%. The pulp was replaced in the bomb and subjected to further treatment with di-oxygen (90 psi) at 60° C. After 1 hour handsheets were prepared in the conventional manner employed for Example I. The ISO brightness was 71.27%, an increase of 21.62 pts., the yellowness (b*) was 10.78.

EXAMPLE 3

Treatment of Spruce TMP (unbleached brightness 49.65%, b* 16.54) with di-oxygen (90 psi) and 8% NaOH The calculated amount of an aqueous solution of sodium hydroxide to give a consistency of 20% was added to the dry pulp. The pulp was thoroughly mixed in a Hobart mixer and placed in a stainless steel bomb fitted with a gas inlet. The bomb was sealed and placed in a water bath at 60° C. The air was removed from the bomb by evacuation and replaced with an atmosphere of di-oxygen at 90 psi. After 1 hour the pressure was released and the bomb opened. The pulp was acidified to pH 6–7 and hand sheets prepared from it in the usual way. The handsheets were darker than those prepared from the original pulp. The ISO brightness had fallen by 6.36 pts. to 43.29%, and the b* had increased to 19.89.

EXAMPLE 4

Treatment of Spruce TMP (unbleached brightness 55.14%, b* 14.37) with 5% $NaBH_4$ and 2% NaOH (under nitrogen, no added di-oxygen).

The calculated amount of an aqueous solution of sodium borohydride and sodium hydroxide to give a consistency of 20% was added to the dry pulp. The pulp was thoroughly mixed in a Hobart mixer and placed in a stainless steel bomb fitted with a gas inlet. The bomb was sealed and placed in a water bath at 60° C. The air was removed from the bomb by evacuation and replaced with an atmosphere of nitrogen at 90 psi. After 2 (experiment 4a) or 4 (experiment 4b) hours the pressure was released and the bomb opened. Handsheets were prepared from the pulp in the conventional manner employed in example 1. The ISO brightnesses for the 2 hour and 4 hour reaction times were 66.24% (an increase of 11.1 pts.), and 65.16% (an increase of 10.02 pts.) respectively. The corresponding yellowness indices (b*) were 8.04 and 8.44.

EXAMPLE 5

Two stage bleaching of Spruce TMP (unbleached brightness 56.30%, b* 14.69) with (i) di-oxygen (90 psi), 5% $NaBH_4$ and 8% NaOH and (ii) 4% alkaline hydrogen peroxide.

(i) First stage. The calculated amount of an aqueous solution of sodium borohydride and sodium hydroxide to give a consistency of 20% was added to the dry pulp. The pulp was thoroughly mixed in a Hobart mixer and placed in a stainless steel bomb fitted with a gas inlet. The bomb was sealed and placed in a water bath at 60° C. The air was removed from the bomb by evacuation and replaced with an atmosphere of di-oxygen at 90 psi. The pulp temperature rose to a maximum of 89° C. after 20 minutes. After 1 hours the pressure was released and the bomb opened. The pulp was acidified to pH 6–7, washed and half of it was made into handsheets using the conventional procedure employed in example 1.

(ii) Second stage. The other half of the pulp was treated with sodium silicate (3% on pulp), DTPA ( % on pulp), sodium hydroxide (2% on pulp) and hydrogen peroxide (4% on pulp). The pulp pH was 10.8 and the consistency 20%. The sample was sealed in a plastic bag in a water bath at 60° C. After two hours handsheets were prepared from the pulp following the conventional procedure employed in example 1.

The handsheets prepared from pulp given only the first stage di-oxygen, $NaBH_4$ and NaOH treatment had an ISO brightness of 72.79%, an increase of 16.49 pts., and a b* of 9.66. The pulp given the second, hydrogen peroxide, treatment was 10.43 pts brighter, with an ISO brightness of 83.22% and a b* of only 5.74. After the second stage bleach, residual peroxide was determined as 83%.

EXAMPLE 6

Treatment of Aspen CTMP (unbleached brightness 64.56%, b* 13.02) with di-oxygen (90 psi), 5% $NaBH_4$ and 8% NaOH The calculated amount of an aqueous solution of sodium borohydride and sodium hydroxide to give a consistency of 20% was added to the dry pulp. The pulp was thoroughly mixed in a Hobart mixer and placed in a stainless steel bomb fitted with a gas inlet. The bomb was sealed and placed in a water bath at 60° C. The air was removed from the bomb by evacuation and replaced with an atmosphere of di-oxygen at 90 psi. The temperature of the pulp, which rose to a maximum of 79° C., was monitored with a thermocouple probe. After 2 hours the pressure was released and the bomb opened. The pulp was acidified to pH 6–7 and hand sheets prepared from it in the usual way. The ISO brightness was 79.03%, an increase of 14.47 pts., the yellowness (b*) was 7.8.

We claim:

1. A process for increasing brightness and reducing yellowness of a high-yield lignin-containing pulp comprising simultaneously bleaching the high-yield pulp with oxygen gas and a borohydride in an exothermic reaction in the presence of an alkaline agent, without delignification of the pulp during the bleaching.

2. A process according to claim 1 wherein said alkaline agent is an alkali metal hydroxide.

3. A process according to claim 2, wherein said borohydride is an alkali metal borohydride.

4. A process according to claim 1, wherein said borohydride is a metal borohydride.

5. A process according to claim 1, wherein said borohydride is an alkali metal borohydride.

6. A process according to claim 1, wherein said pulp is a thermo-mechanical pulp.

7. A process according to claim 1, wherein said pulp is a chemi-mechanical pulp.

8. A process according to claim 1, wherein said pulp is a groundwood pulp.

9. A process according to claim 1, wherein said bleaching is at a temperature of 15° to 90° C.

10. A process according to claim 1, wherein said bleaching is at a temperature of 50° to 70° C.

11. A process according to claim 10, wherein said pulp is a softwood pulp and including a step of recovering a high yield softwood pulp from said bleaching, having a brightness gain of 15 to 20 ISO.

12. A process according to claim 10, wherein said pulp is a hardwood pulp and including a step of recovering a high yield softwood pulp from said bleaching, having a brightness gain of 10 to 15 ISO.

13. A process for increasing brightness and reducing yellowness of a high-yield lignin-containing pulp comprising:

a) in a first stage, simultaneously bleaching the high-yield pulp with oxygen gas and a borohydride in an exothermic reaction in the presence of an alkaline agent, without delignification of the pulp during bleaching and subsequently, b) in a second stage, bleaching the pulp from a) with a peroxide in the presence of an alkaline agent.

14. A process according to claim 13, wherein said peroxide is hydrogen peroxide.

15. A process according to claim 14, wherein said alkaline agent is a) and in b) is sodium hydroxide.

16. A process according to claim 15, wherein said borohydride is an alkali metal borohydride.

17. A process according to claim 13, wherein said alkaline agent in a) and said alkaline agent in b) are each selected from alkali metal hydroxides, alkaline earth metal hydroxides, alkali metal carbonates, alkaline metal carbonates, borates and salts which release hydroxide ions.

18. A process according to claim 13, wherein said alkaline agent in a) and in b) is sodium hydroxide.

19. A process according to claim 18, wherein said borohydride is an alkali metal borohydride.

20. A process according to claim 13, wherein said first stage bleaching is at a temperature of 15° to 90° C.

21. A process according to claim 20, wherein said temperature is 50° to 70° C.

22. A process according to claim 13, wherein said pulp is selected from thermo-mechanical pulp, chemi-mechanical pulp or groundwood pulp.

23. A process for increasing brightness and reducing yellowness of a high yield pulp comprising:

bleaching a high yield lignin-containing mechanical pulp without delignification of the pulp during the bleaching, said bleaching being carried out at a pH of 9 to 14 in a single stage bleaching simultaneously with oxygen gas and sodium borohydride, in an exothermic reaction, said borohydride being in an amount of 1 to 5%, by weight, based on the weight of pulp, in the presence of sodium hydroxide in an amount of 1 to 8%, by weight, based on the weight of pulp, and recovering a resultant high yield lignin-containing pulp of increased brightness and reduced yellowness.

24. A process according to claim 23, wherein said single stage bleaching is followed by a separate, second stage bleaching at a pH of 9 to 14 with a peroxide in the presence of sodium hydroxide.

25. A process according to claim 23, wherein said bleaching is carried out at a temperature of 15° to 70° C.

* * * * *